US009284509B2

(12) United States Patent
Maurin-Perrier et al.

(10) Patent No.: US 9,284,509 B2
(45) Date of Patent: Mar. 15, 2016

(54) FRICTION PIECE OPERATING IN A LUBRICATED MEDIUM

(71) Applicant: H.E.F., Andrezieux Boutheon (FR)

(72) Inventors: Philippe Maurin-Perrier, Saint Marcellin en Forez (FR); Christophe Heau, Saint-etienne (FR)

(73) Assignee: H.E.F., Andrezieux Boutheon (FR)

( * ) Notice: Subject to any disclaimer, the term of this patent is extended or adjusted under 35 U.S.C. 154(b) by 60 days.

(21) Appl. No.: 14/350,507

(22) PCT Filed: Oct. 3, 2012

(86) PCT No.: PCT/FR2012/052236
§ 371 (c)(1),
(2) Date: Apr. 8, 2014

(87) PCT Pub. No.: WO2013/057407
PCT Pub. Date: Apr. 25, 2013

(65) Prior Publication Data

US 2014/0274826 A1 Sep. 18, 2014

(30) Foreign Application Priority Data

Oct. 21, 2011 (FR) ..... 11 59546

(51) Int. Cl.

| | |
|---|---|
| ***F16C 33/10*** | (2006.01) |
| ***C10M 171/00*** | (2006.01) |
| ***C23C 16/10*** | (2006.01) |
| ***C23C 16/34*** | (2006.01) |

(Continued)

(52) U.S. Cl.
CPC ..... *C10M 111/02* (2013.01); *C10M 135/18* (2013.01); *C23C 30/005* (2013.01); *C10M 103/06* (2013.01); *C10M 105/72* (2013.01); *C10M 2201/0613* (2013.01); *C10M 2219/068* (2013.01); *C10N 2230/06* (2013.01); *C10N 2240/04* (2013.01); *C10N 2240/10* (2013.01); *C10N 2280/00* (2013.01)

(58) Field of Classification Search
CPC ..... C10M 2219/068; C10M 111/02; C10M 135/18; C10M 105/72; C10M 103/06; C10M 2201/0613; C10N 2210/06; C10N 2240/04; C10N 2280/00; C10N 2230/06; C10N 2240/10; C23C 30/005
USPC ..... 508/100, 167, 363; 384/625, 190.5, 384/482; 106/733; 361/704
See application file for complete search history.

(56) References Cited

U.S. PATENT DOCUMENTS

| | | | | |
|---|---|---|---|---|
| 5,449,547 | A * | 9/1995 | Miyazaki et al. | 428/217 |
| 5,582,414 | A * | 12/1996 | Miyazaki et al. | 277/444 |
| 2007/0060483 | A1* | 3/2007 | Konishi et al. | 508/167 |
| 2007/0078067 | A1* | 4/2007 | Nakagawa et al. | 508/363 |
| 2008/0146468 | A1* | 6/2008 | Konishi et al. | 508/109 |
| 2010/0247004 | A1* | 9/2010 | Suzuki et al. | 384/13 |

OTHER PUBLICATIONS

Non-ferrous coating/lubricant interactions in tribological contacts: Assessment of tribofilms by T Haque A Morina A Neville R Kapadia S Arrowsmith Tibology International 40 (2007) 1603-1612.*

(Continued)

*Primary Examiner* — Pamela H Weiss
(74) *Attorney, Agent, or Firm* — Heslin Rothenberg Farley & Mesiti P.C.

(57) ABSTRACT

The lubricated environment incorporates a friction modifier, and a coating is applied to the part. The coating is chromium nitride and the friction modifier is MoDTC. The chromium nitride presents an NaCl-type crystallization and a micro-hardness of 1,800+/−200 HV.

4 Claims, 1 Drawing Sheet

(51) Int. Cl.

| | |
|---|---|
| ***C10M 111/02*** | (2006.01) |
| ***C10M 135/18*** | (2006.01) |
| ***C23C 30/00*** | (2006.01) |
| *C10M 103/06* | (2006.01) |
| *C10M 105/72* | (2006.01) |

(56) References Cited

OTHER PUBLICATIONS

De Barros'Bouchet M I et al; "Boundary lubrication mechanisms of carbon coatings by MoDTC and ZDDP additives," Tribology International, Butterworth Scientific LDT, Guildford, GB, vol. 38, No. 3, Mar. 1, 2005, pp. 257-264.

Haque, et al; "Non-ferrous coating/lubricant interactions in tribological contacts: Assessment of tribofilms," Tribology International, Butterworth Scientific LDT, Guildford, GB, vol. 40, No. 10-12, Aug. 28, 2007, pp. 1603-1612.

Haque, et al; "Tribochemical interactions of Friction Modifier and Antiwear Additives with CrN Coating Under Boundary Lubrication Conditions," Journal of Tribology, vol. 130, Oct. 31, 2008, p. 042302-1.

International Search Report for PCT/FR2012/052236 dated Jan. 28, 2013.

* cited by examiner

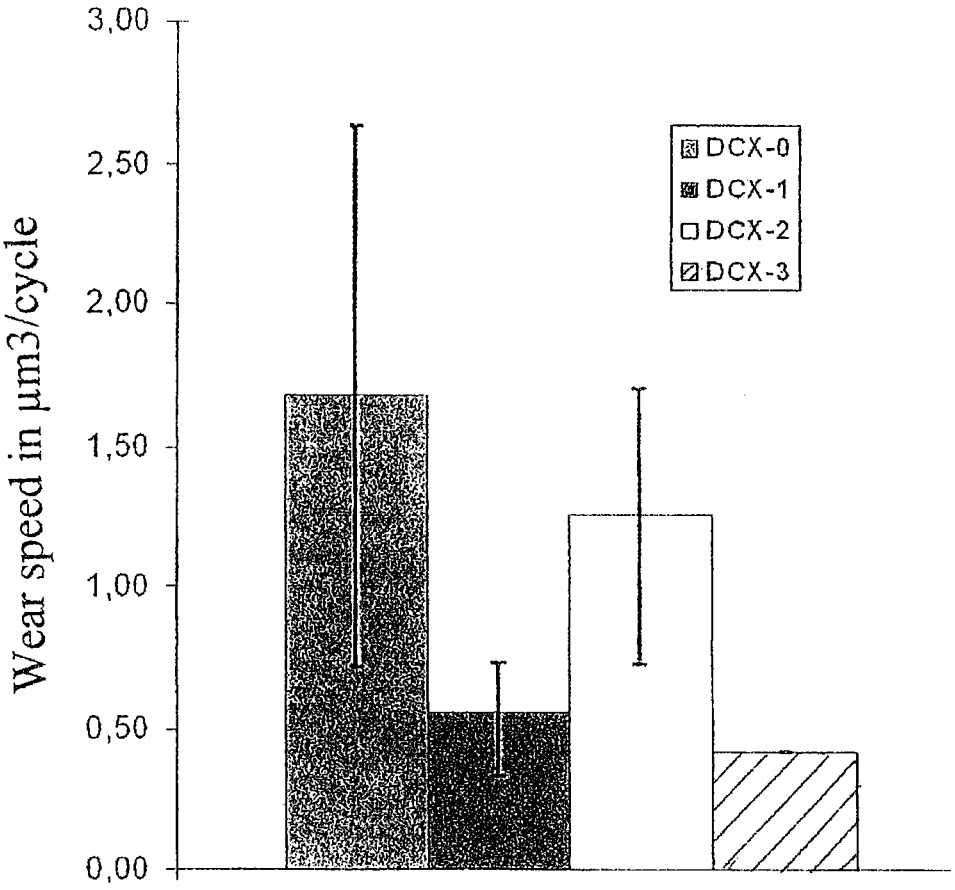
3,00
2,50
2,00
1,50
1,00
0,50
0,00
Wear speed in µm3/cycle
DCX-0
DCX-1
DCX-2
DCX-3

FRICTION PIECE OPERATING IN A LUBRICATED MEDIUM

CROSS REFERENCE TO RELATED APPLICATIONS

This application is a national stage filing under section 371 of International Application No. PCT/FR2012/052236 filed on Oct. 3, 2012, and published in French on Apr. 25, 2013 as WO 2013/057407 A1 and claims priority of French application No. 1159546 filed on Oct. 21, 2011, the entire disclosure of these applications being hereby incorporated herein by reference.

BACKGROUND ART

The invention concerns the technical domain of tribology in a lubricated environment.

More particularly, the invention concerns friction parts operating in a lubricated environment incorporating a friction modifier, such as automotive parts, for example.

It is well-known for a professional to use thin coatings such as DLC to reduce the friction of mechanical parts operating in a lubricated environment.

DLC coatings are also known to fulfill a second function, which is to protect the coatings against wear.

Still with the objective of enabling a significant reduction in friction coefficient, it has been proposed to add an additive that is a friction modifier. Such an additive is advantageously MoDTC which, in hot friction contact, reacts chemically to give rise to compounds such as $MoS_2$, which is perfectly known by a professional to act as a solid lubricant.

Basing oneself on this state of the art, it can seem advantageous to combine the effects of DLC and MoDTC to benefit from the effect of synergy between the two of them, so as to further reduce the friction coefficient.

However, after performing tests, it appears that such a combination does not give satisfactory results. Notably, it has been observed that DLC coatings that contain hydrogen have a high rate of wear in the presence of MoDTC. When the DLC coating is not hydrogenated, the wear phenomenon is less pronounced but, in this case, the application is a complex and costly technique.

BRIEF SUMMARY OF THE INVENTION

In a surprising and unexpected manner, tests have shown that, in a lubricated environment incorporating an MoDTC friction modifier, the fact of replacing the DLC coating with a chromium nitride coating gives particularly satisfying results both as regards reducing the friction and with regard to protecting the part in question against wear.

In other words, contrary to the DLC used in a lubricated environment incorporating an MoDTC friction modifier in which there is a wear phenomenon, such a phenomenon does not occur with chromium nitride.

Therefore, the invention lies in the combination of the effects of chromium nitride and MoDTC, allowing a significant reduction of the friction coefficient without deteriorating the hardness.

This selection of chromium nitride is contrary to the general knowledge of professionals, who currently use DLC practically exclusively in lubricated environments, with no friction modifier instead of chromium nitride.

BRIEF DESCRIPTION OF THE DRAWING FIGURES

FIG. 1 illustrates average wear speeds for different coatings

DETAILED DESCRIPTION

Friction tests have been performed in order to evaluate behavior in a lubricated environment incorporating an MoDTC friction modifier, a DLC coating and a chromium nitride coating, remembering that, in a perfectly known manner, in the case of a DLC coating, in order to strengthen its mechanical strength, one can deposit a sub-layer—for example, of chromium nitride. Refer to the table below, which shows the tests performed on four coatings, namely DCX-0, DCX-1, DCX-2 and DCX-3, with the DCX-3 coating being in accordance with the invention.

| Reference | Description |
|---|---|
| DCX-0 | CrN (0.8 μm) + DLC (2.0 μm) |
| DCX-1 | CrN (0.8 μm) + DLC (2.0 μm) + a-C (0.8 μ) |
| DCX-2 | CrN (0.8 μm) + DLC (2.0 μm) + $O_2$ plasma finish |
| DCX-3 | CrN (0.8 μm) |

The set of layers incorporates a chromium nitride coating formed by magnetron reactive cathodic spraying. For all the coatings, one initially cleans the steel test pieces, and then positions them on mountings placed within the vacuum deposition chamber. During the pumping and evacuation of the chamber, one heats the interior of the machine and the parts to be coated, to a temperature of 150° C. for 2 hours, in order to degas the parts and the deposition machine. The parts are then subjected to an ionic scrubbing in an argon atmosphere, of which the purpose is to eliminate the thin layers of natural oxide and thereby permit a strong adherence of the coating. The deposition of chromium nitride is obtained by magnetron reactive cathodic spraying of a Cr target in an argon/nitrogen mixture. The flow of nitrogen is servocontrolled by an optical measurement of the emission of Cr in the plasma, such that the deposit contains atomic 40+/−5% of nitrogen. Thus, one obtains a deposit of CrN with an NaCL-type CFC crystallization of which the microhardness is 1,800+/−200 Hv. With the DCX-0, DCX-1 and DCX-2 coatings, one deposits a coating of a-C:H-type DLC using a PACVD technique, cracking a hydrocarbon in a plasma—of acetylene in this case. In the case of DCX-1, one applies the final deposit of a layer of a-C type by magnetron cathodic spraying of a graphite target. In the case of DCX-2, one generates a plasma of pure oxygen and one bombards the deposit with ions from the plasma for 10 minutes, which modifies the surface chemistry of the deposit.

These tests are performed with an alternating tribometer in ballbearing-on-surface configuration. For these tests, the surface is composed of a steel test piece polished to an Ra level of 0.02 μm. The ball is made of 100Cr6 steel and is of 10 mm diameter. For all the tests, the coatings are applied to the ballbearing.

The load applied to the ballbearing is 10 N, which gives a Hertzian diameter of contact of 140 μm and an average pressure of 0.68 GPa.

The ballbearing is animated with an alternating movement, of which the travel is 10 mm. The sliding speed follows a profile of sinus type, of which the average value is 3.5 cm/sec.

The test is conducted for 15,000 cycles at a temperature of 110° C. The sliding speed, pressure and temperature conditions are such that the friction reduction additive reacts to fulfill its role. At the end of the test, one observes the ballbearing and one measures the diameter of the friction trace or wear trace, from which one calculates the volume worn. The appended graphic (FIG. 1) summarizes the average wear speeds (worn volume rounded-off to the number of friction cycles). For each coating, three tests are performed, and the average wear is calculated. The error bars represent not an error but the smallest value and the biggest value for the three tests.

For each of the tests, and for the different coatings, the measurements are performed in the presence of a commercially-available automotive oil containing the MoDTC friction modifier.

The following observations can be arrived at, in respect of this graphic:

- For the DCX-0 coating, the wear is particularly strong, which moreover is not the case for the same type of coating in a lubricated environment not incorporating an MoDTC friction modifier.
- For the DCX-1 coating, the addition of a non-hydrogenated amorphous carbon layer on top of the DLC tends to reduce the wear speed by a factor of around 2.9.
- For the DCX-2 coating, one sees that the modification of the DLC surface by an oxygen plasma does not have a significant influence on the wear speed of the DLC, whereas the surface energy is completely modified.
- The DCX-3 coating in accordance with the invention presents nil wear at the end of testing; the friction diameter is very slightly greater than the initial contact diameter.

The chromium nitride has a hardness of approximately 1,800 Hv.

The table below summarizes the values for average wear speed that feature in the appended graphic.

| Reference | Wear speed in $\mu m^3$/cycle |
|---|---|
| DCX-0 | 1.68 |
| DCX-1 | 0.56 |
| DCX-2 | 1.26 |
| DCX-3 | 0.42 |
| Steel | 0.45 |

The table below states the friction coefficients at the end of testing.

| Reference: | Friction coefficient |
|---|---|
| DCX-0 | 0.031/−0.016 |
| DCX-1 | 0.032/−0.009 |

-continued

| Reference: | Friction coefficient |
|---|---|
| DCX-2 | 0.025/−0.003 |
| DCX-3 | 0.031/−0.001 |
| Steel | 0.040/−0.005 |

It comes to the fore from these tables that all the solutions incorporating a coating present similar average friction coefficients.

The strong dispersal in the case of DCX-0 is due to wear. One will note that the lowest friction coefficients are obtained with the most-worn deposits.

The low friction coefficient is essentially due to the friction reduction additive: the MoDTC.

As an example, and as shown in the last line of the tables, the test with an uncoated ballbearing exposed to an uncoated surface returns a friction coefficient of 0.040+/−0.005. The average wear speed is 0.45. Although this solution resists wear, thanks to the anti-wear additives in the oil, it returns nonetheless a 30% higher friction coefficient.

In comparison, the friction of a ballbearing coated with DLC (DCX-0) exposed to a steel surface, using an SAE 5W30 oil (without any friction modifier) returns a wear speed of 0.3+/−0.05 $\mu m^3$/cycle; however, the friction coefficient stabilizes at 0.12. In an SAE 5W30 oil with a friction reduction additive of fatty acid type, the wear speed is 0.32+/−0.05 $\mu m^3$/cycle and the friction coefficient is 0.08.

It results from the above that DLC coatings of DCX-0 type withstand wear well in oils without MoDTC, observing that these oils do not allow the achievement of friction coefficients as low as those containing MoDTC type.

In other words, the DLC combination in the presence of a friction antagonist in steel—MoDTC—is not compatible for fulfilling the two functions, i.e. withstanding wear, on the one hand, and, on the other hand, obtaining a friction coefficient that is as low as possible, whereas the claimed combination—namely, chromium nitride and MoDTC—advantageously fulfills these two functions.

The invention also concerns the use of parts thus coated and working in a lubricated environment containing MoDTC in the automotive field, notably for engines and gearboxes.

The invention claimed is:

1. A combination of two friction parts and a lubricant including a friction modifier, wherein none of said friction parts is coated with DLC, wherein the friction modifier comprises MoDTC, and wherein at least one of said friction parts includes a coating comprising chromium nitride presenting an NaCl-type crystallization and a microhardness of 1,800+/−200 HV.

2. The combination of claim 1, wherein the friction parts comprise automotive parts.

3. The combination of claim 2, wherein the automotive parts comprise engine parts.

4. The combination of claim 2, wherein the automotive parts comprise gearbox parts.

* * * * *